US008635734B2

(12) United States Patent
Chun et al.

(10) Patent No.: US 8,635,734 B2
(45) Date of Patent: Jan. 28, 2014

(54) TOOTHBRUSH WITH BRISTLES OF NON CIRCULAR TIPS

(75) Inventors: James Chun, Raleigh, NC (US); Jennifer Miseong Chun, Raleigh, NC (US)

(73) Assignee: Hankookin, Inc, Raleigh, NC (US)

( * ) Notice: Subject to any disclaimer, the term of this patent is extended or adjusted under 35 U.S.C. 154(b) by 0 days.

(21) Appl. No.: 13/027,330

(22) Filed: Feb. 15, 2011

(65) Prior Publication Data

US 2012/0204371 A1 Aug. 16, 2012

(51) Int. Cl.
*A46B 9/04* (2006.01)

(52) U.S. Cl.
USPC ..... 15/167.1; 15/207.2

(58) Field of Classification Search
USPC ..... 15/167.1, 207.2
See application file for complete search history.

(56) References Cited

U.S. PATENT DOCUMENTS

| | | | | | |
|---|---|---|---|---|---|
| 2,317,485 | A * | 4/1943 | Rider | ..... | 15/167.1 |
| 3,613,143 | A * | 10/1971 | Muhler et al. | ..... | 15/167.1 |
| 4,646,381 | A * | 3/1987 | Weihrauch | ..... | 15/167.1 |
| 5,396,678 | A * | 3/1995 | Bredall et al. | ..... | 15/167.1 |
| 6,141,818 | A * | 11/2000 | Weihrauch | ..... | 15/167.1 |
| 6,269,514 | B1 * | 8/2001 | Edwards et al. | ..... | 15/159.1 |
| 2008/0209649 | A1 * | 9/2008 | Herzog | ..... | 15/22.1 |

* cited by examiner

*Primary Examiner* — Randall Chin
(74) *Attorney, Agent, or Firm* — Ash Tankha; Lipton, Weinberger & Husick

(57) ABSTRACT

A toothbrush having a handle with a longitudinal axis, a toothbrush head, constructed and arranged to hold bristles and a plurality of bristles, whereby said bristles are formed in a non-circular configuration whereby the non circular configuration is on at least one of a distal end, a portion including the distal end or the entire bristle.

3 Claims, 7 Drawing Sheets

TOOTHBRUSH WITH BRISTLES OF NON CIRCULAR TIPS

BACKGROUND OF THE INVENTION

Field of the Invention

Dental health and hygiene is an area that is still subject to many improvements. The toothbrush has seen numerous improvements and advancements in recent years. However, with all the improvements, The tooth brushing technique recommended by ADA and most dentists is to tilt the brush at a 45° angle against the gum-line with gentle force, brush forward and backward in short vibratory movement, and sweep or roll the brush away from the gum-line.

More force should be applied in the rolling or sweeping movements to remove the plaque and debris between the teeth. The efficacy of tooth brushing remains an unnoticed but pressing issue.

In fact, most people brush with circling motion. According to a research article by C. Ganss, N. Schlueter, S. Preiss and J. Klimek (Clinical Oral Investigations, Volume 13, Number 2, 203-208, 2008): the mean brushing force was 2.3±0.7 N (max. 4.1 N); most subjects (73.8%) brushed with circling, 8.7% with horizontal/scrubbing, 13.6% with horizontal/circling and 3.9% with vertical sweeping movements. Many electric toothbrushes such as Oral-B also use circling brushing motion. Thus there is discrepancy between the ADA recommendation and the common brushing techniques.

Vigorous tooth brushing can cause gum and root recession, tooth sensitivity and tooth abrasion such as wedge shape defects and dental erosion. Even though most dentists recommend using tooth brushes with soft or medium bristles, tooth abrasion are still very common among people with over-vigorous oral hygiene habits.

The horizontal defects are mostly due to the brushing force forward and backward across the teeth surface, and this is the reason why ADA emphasis on the sweeping or rolling motion to brush plaque and debris away from the gum-line.

SUMMARY OF THE INVENTION

The present invention addresses these deficiencies by providing a novel geometric configuration of the shape of the tooth brush bristle to reduce the brushing force in the horizontal forward and backward direction, while emphasis on the sweeping or rolling force during brushing. Instead of using the commonly used bristle with round cross section, bristles with oval cross-section are provided and the major axis of the oval cross-section of the bristles are aligned perpendicular to the long axis of the brush handle.

In one embodiment the present invention is a toothbrush, comprising:

- a handle having a longitudinal axis;
- a toothbrush head, constructed and arranged to hold bristles;
- a plurality of bristles, whereby said bristles are formed in a non-circular configuration as viewed from a first end being a proximal end that is attached to the toothbrush head, a second end, wherein the second end is a distal end that is not connected to the toothbrush head and intended to contact teeth during brushing, or in cross section from some area along the length of the bristle.

In one embodiment, the bristled are circular for some portion of the bristle body and the distal or second end has the non-circular configuration.

In one embodiment, the non-circular configuration is an elliptical configuration as viewed from any of the first end, second end, or in cross section. If the bristles are circular with a non-circular distal end, the noncircular configuration is viewed from the second end or in cross section near the distal end.

The elliptical configuration is defined by a geometric eccentricity greater than 0. The elliptical configuration has a major axis perpendicular to said longitudinal axis. In one embodiment, the toothbrush further comprises a circular socket with bristles placed thereon. The plurality of bristles in one embodiment are inserted to a non-circular socket.

The invention also relates to a toothbrush bristle comprising:

a continuous elongated body a continuous wall defining said body, said bristle having a cylindrical non-circular distal end.

The non circular portion may be on the end of the bristle, a portion including the end of the bristle, or extend for the entire length of the bristle. The non circular portion extends for less than the entire length of the bristle, the remaining portion is circular. As discussed herein, non circular included elliptical and oval configurations.

DETAILED DESCRIPTION OF THE INVENTION

The toothbrush bristles of the present invention relate to the geometric configuration of the individual bristle fibers. While all bristles conventionally utilized are cylindrical, meaning the cross section is a circle, the present invention provides for curved cylindrical bristles that are non-circular. As used herein, the term, curved cylinder describe the geometric configuration of curved bristles that do not have a circular cross section. This includes, all elliptical configurations and ovals. The present invention includes toothbrush bristles formed of materials known in the art and is particular to the geometric configuration and not the material composition.

Figure 5:
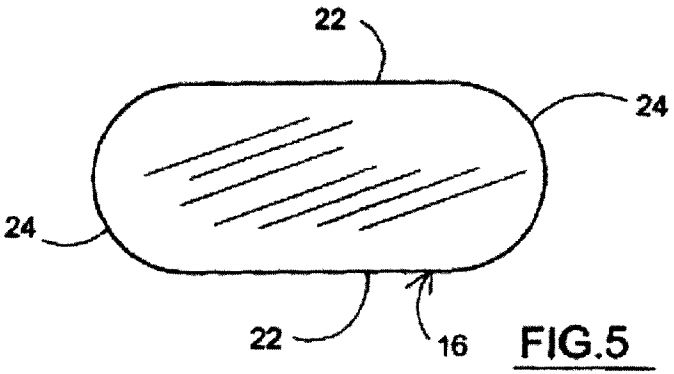
FIG. 5 is a top view of a single oval bristle.
Figure 6:
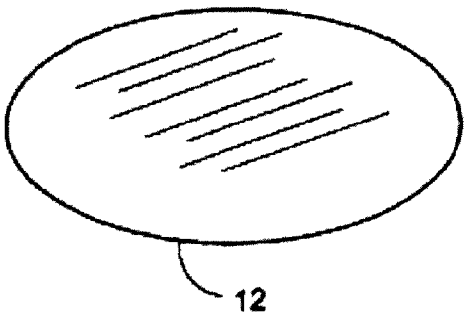
FIG. 6 is a top view of a single elliptical bristle.
Figure 13:
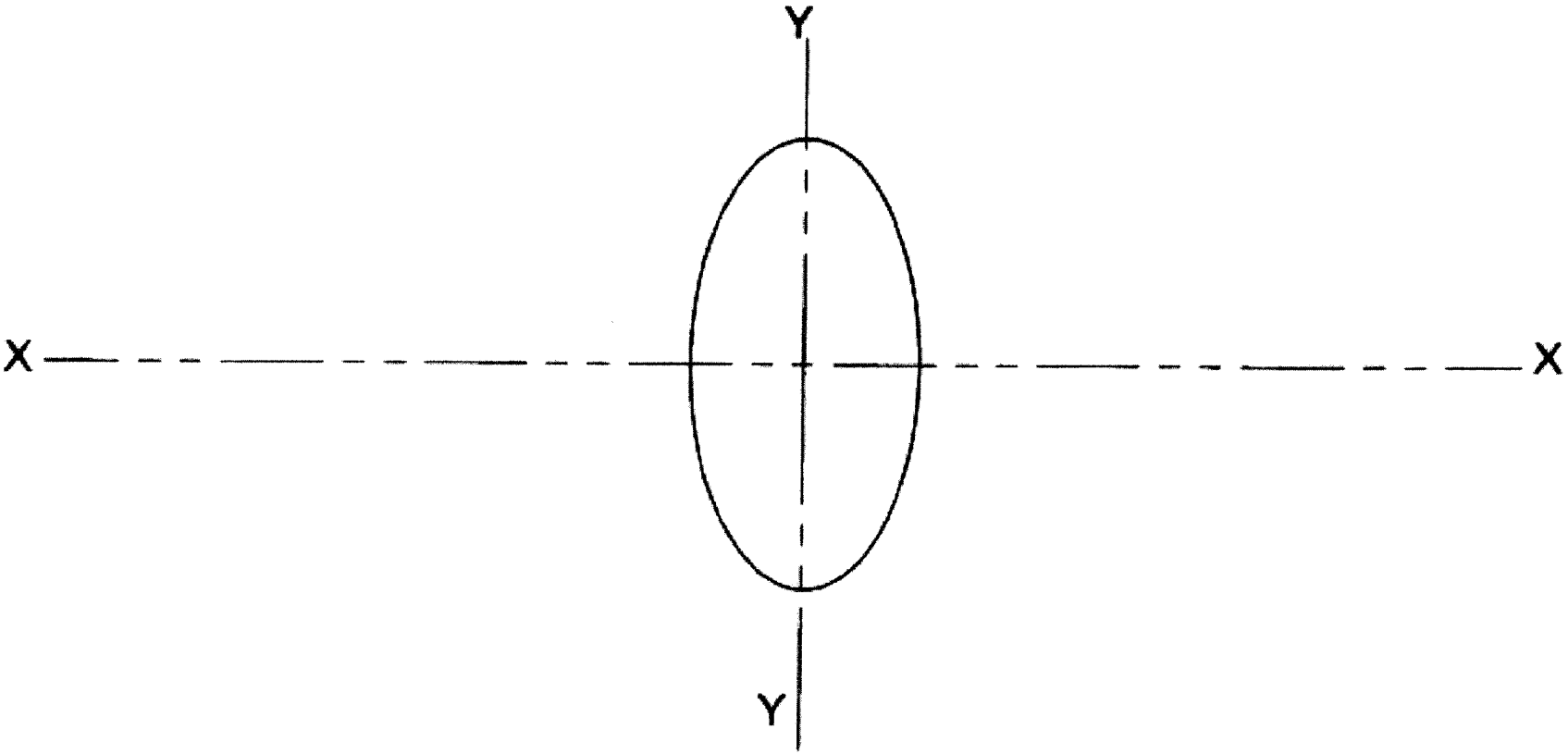
FIG. 13 is a top view of a single elliptical bristle.

As best shown in FIG. 5, a bristle with an oval configuration has opposing, substantially parallel sides 22 and opposing radial ends 24; and in FIG. 6, a bristle with an elliptical configuration has a continuous non-circular curvature. As known in the art, and shown in FIG. 13, an ellipse configured bristle has a semimajor axis Y and a semiminor axis X.

As is known, an ellipse has a first focus point and a second focus point (collectively foci) along the semimajor axis. The foci of the ellipse are equidistant from the center point. The eccentricity of an ellipse, is the ratio of the distance between the two foci, to the length of the major axis. For an ellipse the eccentricity is between 0 and 1. When the eccentricity is 0 the foci coincide with the center point and the figure is a circle. As the eccentricity tends toward 1, the ellipse gets a more elongated shape. It tends towards a line segment. For the present invention, the bristles that have an elliptical configuration have an eccentricity greater than zero so as to exclude circle configurations. The degree of elongation can be varied in order to perform the present invention.

The present invention has discovered several embodiments, all with non-circular bristles, that are functional to varying degrees.

Figure 1:
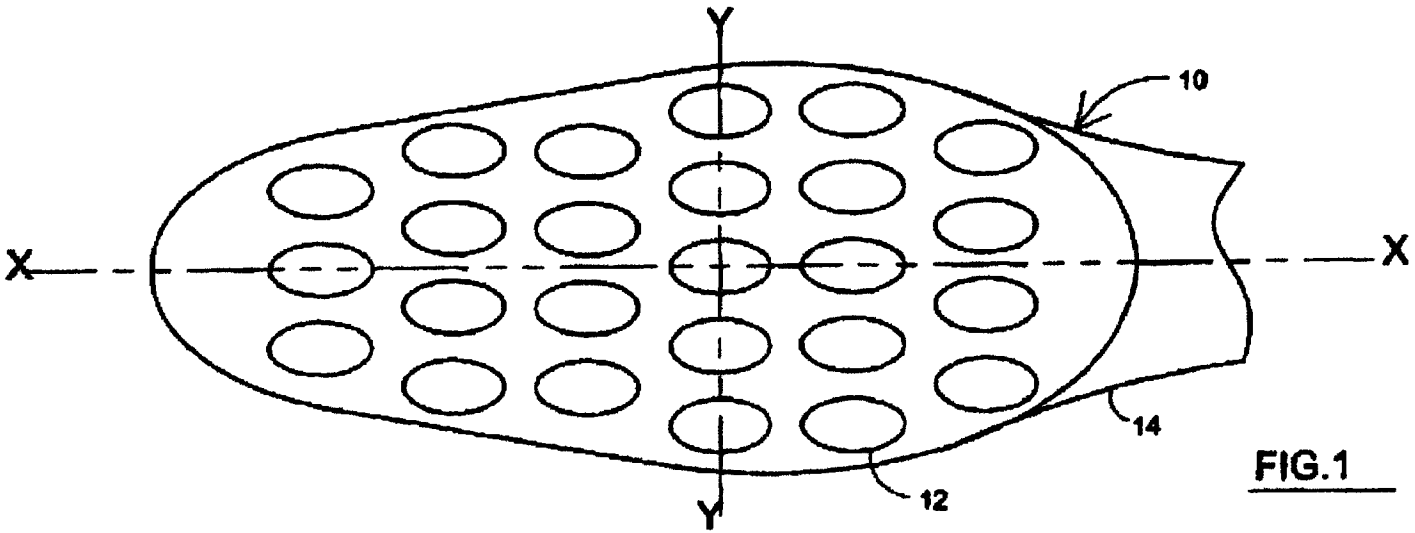
FIG. 1 shows a plan view of an embodiment of the present invention where bristles are arranged in elliptical bundles along a longitudinal axis.

FIG. 1 is a plan view that is simplified for demonstrative purposes. The X axis of FIG. 1 represents the longitudinal axis of a toothbrush which would also include a toothbrush handle 14 (only connective portion shown) that is integral with toothbrush head 10. Elliptical bristle 12 has a semimajor axis parallel to longitudinal axis A of FIG. 1. for demonstrative purposes only, FIG. 1 is intended to depict the general orientation of individual bristles.

Figure 2:
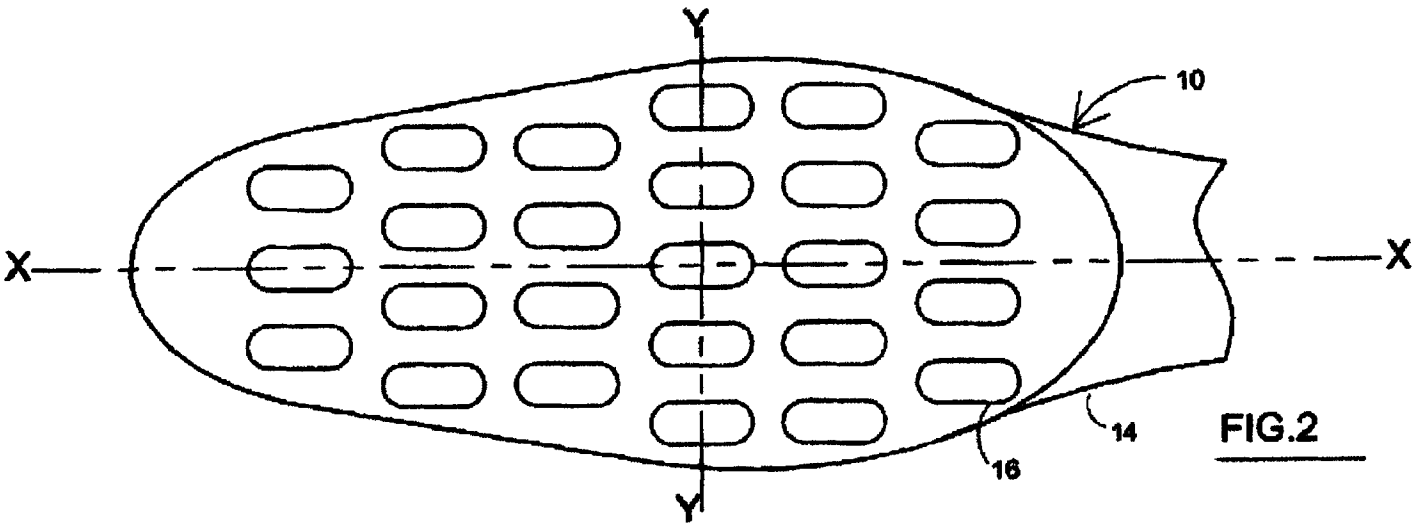
FIG. 2 shows a plan view of an embodiment of the present invention where bristles are arranged in oval bundles along a longitudinal axis.

FIG. 2 is a plan view that is simplified for demonstrative purposes. The X axis of FIG. 1 represents the longitudinal axis of a toothbrush which would also include a toothbrush handle 14 (only connective portion shown) that is integral with toothbrush head 10. Oval bristle 16 has a longitudinal axis parallel to longitudinal axis A of FIG. 2. For demonstrative purposes only, FIG. 2 is intended to depict the general orientation of individual bristles.

Figure 3:
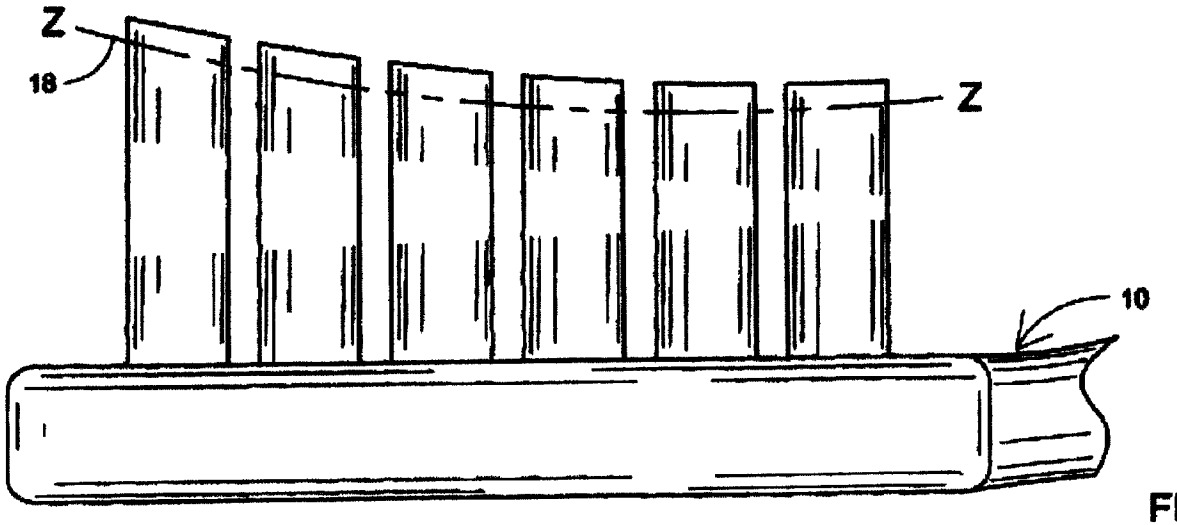
FIG. 3 is a side view of a toothbrush head showing curved arrangement of bristle height.
Figure 4:
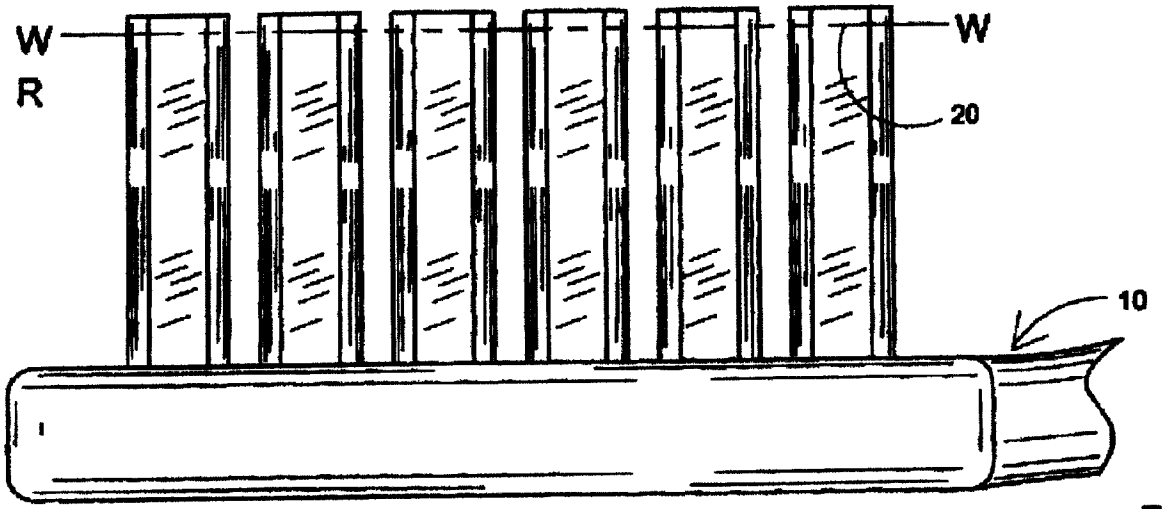
FIG. 4 is a side view of a toothbrush head showing congruent arrangement of bristle height.

FIGS. 3 and 4 demonstrate that bristle arrangements of the present invention include ends that form curved profile 18 and bristle ends that form a horizontal profile 20.

Figure 7:
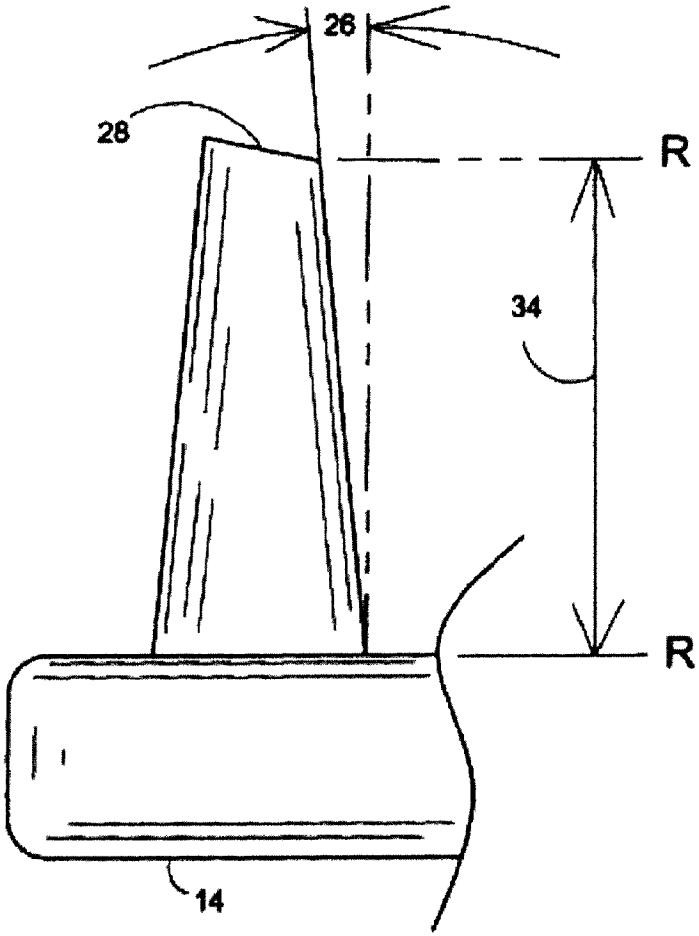
FIG. 7 is a side view of a single bristle.

FIG. 7 shows a single bristle on toothbrush head 10 in which bristle has a chisel end 28 and moves with angular offset 26 based on height of bristle 34. Angular offset can be varied as desired in order to improve efficiency of brushing without adverse application of force.

Figure 10:
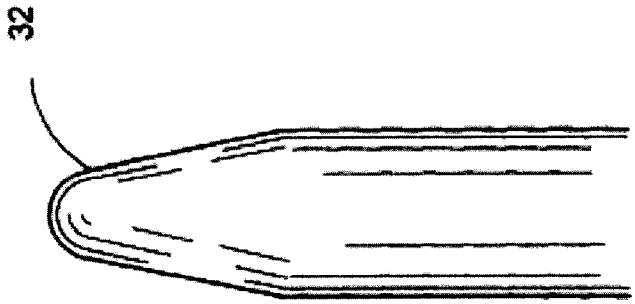
FIG. 10 is a partial side view of a single bristle with a tapered tip.
Figure 9:
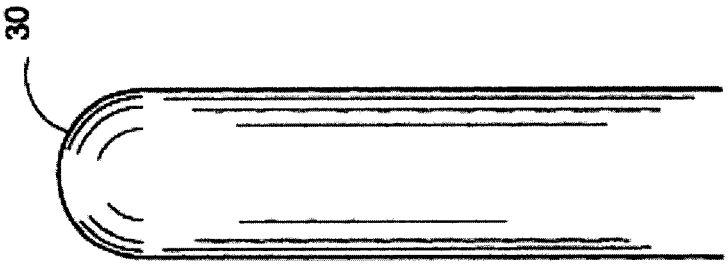
FIG. 9 is a partial side view of a single bristle with a round tip.
Figure 8:
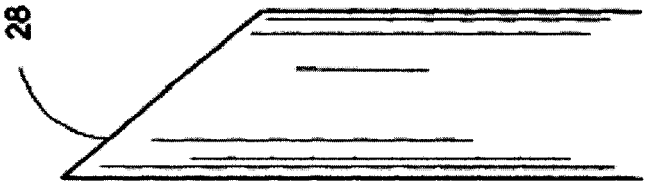
FIG. 8 is a partial side view of a single bristle with a chisel point tip.

FIGS. 8-10 show that the present invention is operable to toothbrushes having varying end configurations including, but not limited to, chisel point end in FIG. 8, round tip 30 in FIG. 9, and tapered end 32 in FIG. 10.

Figure 11:
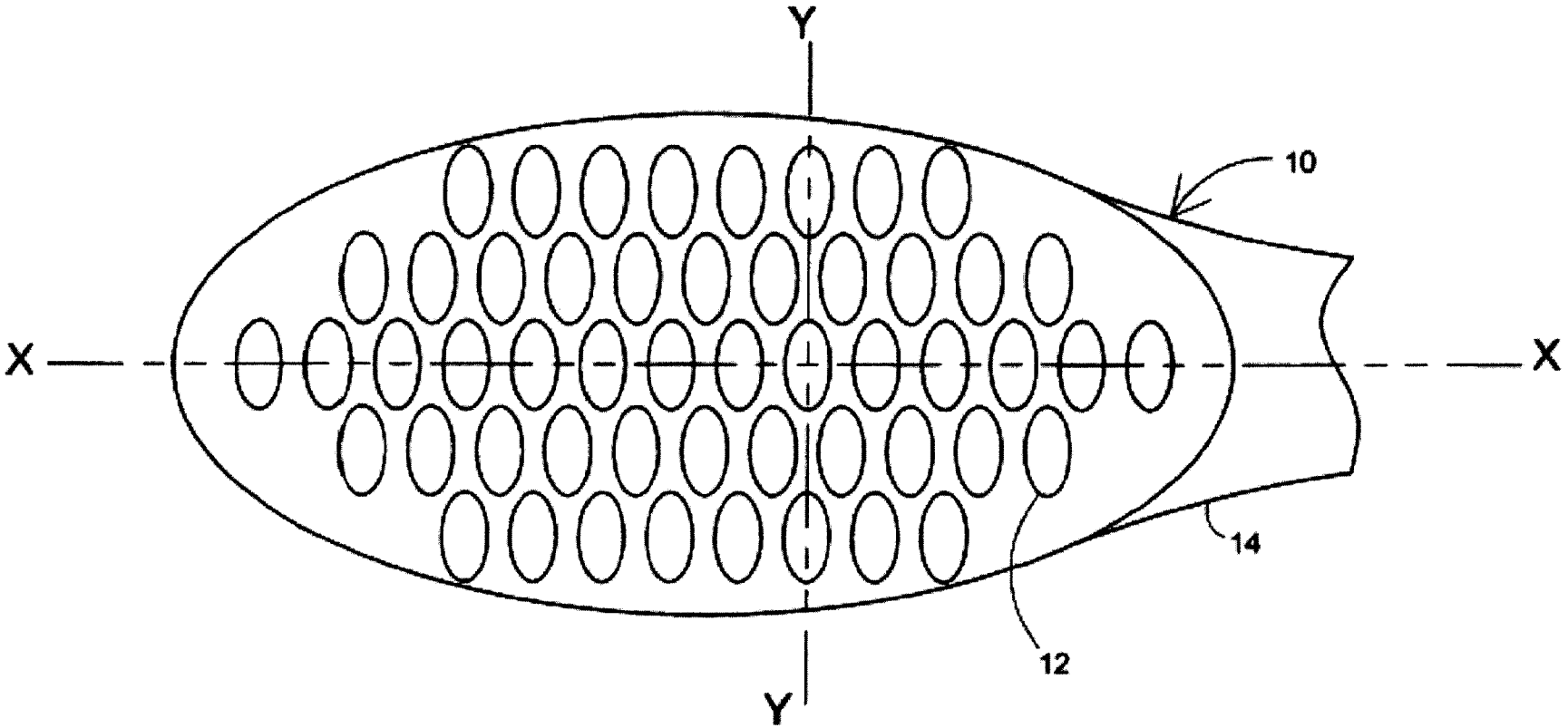
FIG. 11 is a plan view of a toothbrush head having bristles arranged perpendicular to a longitudinal axis.

FIG. 11 also depicting a demonstrative embodiment to show the orientation of individual elliptical bristles 12 oriented with a semimajor axis that is perpendicular to toothbrush longitudinal axis X.

Figure 12:
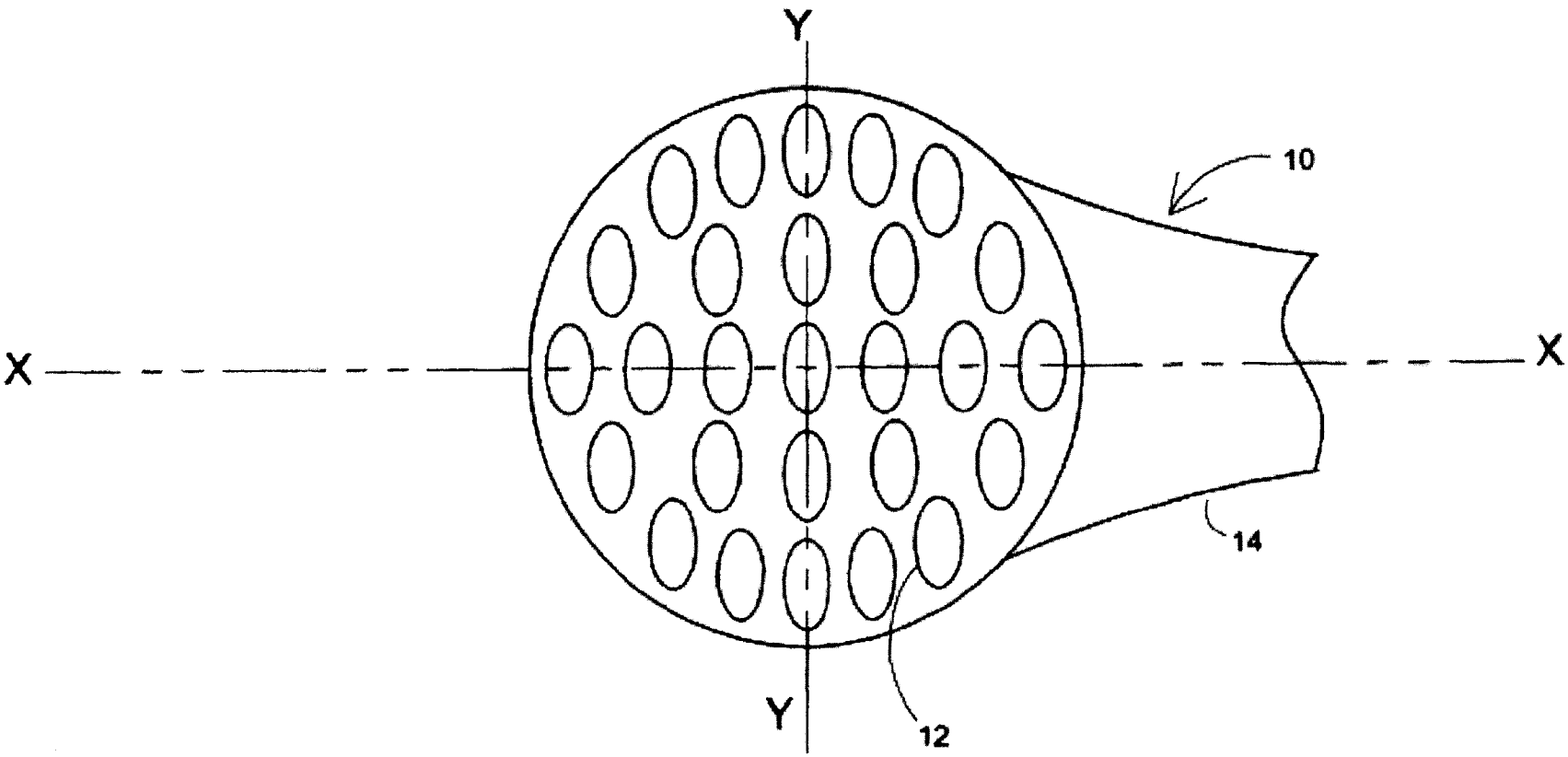
FIG. 12 is an expanded view showing arrangements of individual elliptical bristles in a circular bundle.

FIG. 12 show a single bundle of bristles in a circular bristle socket. The individual bristles 12 are elliptical, but the bundle is circular. In this embodiment the semimajor axis of each of elliptical bristles 12 is perpendicular to the toothbrush longitudinal axis X.

The present invention has addressed a deficiency in the art. Current circular bristles are utilized with an over application of force and results in damage to teeth. Utilization of non-circular bristles provides different distribution of force and allows teeth to be effectively brushed with reduced pressure and force on tooth surfaces.

In one embodiment, the proposed bristle fiber with non-circular cross-section can be used in combination with bristle fiber with round cross-section, where in part of the region of the toothbrush area, the non-circular type of bristle are used, while in other regions, round cross-section bristles are use. That is to say, the distal end of the bristle is non-circular and the remaining portion of the bristle is circular. Remaining section, as used herein, is any remaining portion that is not at or near the distal end.

Although the invention has been described with reference to specific embodiments and drawings, it is to be understood that the invention is not limited to those precise embodiments, and that various changes and modifications may be effected by one skilled in the art without departing from the scope or spirit of the present invention.

We claim:

1. A toothbrush, comprising:

a handle, said handle having a longitudinal axis;

a toothbrush head, said toothbrush head generally shaped to be accommodated along said longitudinal axis and fixedly attached to said handle, said toothbrush head comprising at least one non-circular socket; and a plurality of bristles having a first end and a second end, wherein said first end is attached to said toothbrush head, and said second end is defined by a distal end opposite to said first end, wherein said plurality of bristles are attached to said toothbrush head through said first end, wherein said bristles have a continuous elongated body, wherein at least one of said bristles has a non-circular cross-section extending for the entire length of said at least one bristle, wherein said non-circular cross-section is an elliptical cross section as viewed from said first end and said second end, wherein said non-circular cross-section comprises a major axis perpendicular to said longitudinal axis of said handle, wherein said bristle with said non-circular cross-section is configured to reduce brushing force in a horizontal forward and backward direction along said longitudinal axis of said handle, and increase said brushing force in a direction along said major axis, wherein at least one of said plurality of bristles are adapted to be accommodated in said at least one non-circular socket of said toothbrush head.

2. The toothbrush of claim 1, wherein said elliptical configuration is defined by a geometric eccentricity greater than 0.

3. The toothbrush of claim 1, wherein said toothbrush head further comprises a plurality of circular sockets adapted to accommodate said plurality of bristles.

* * * * *